United States Patent [19]

Pries et al.

[11] 4,328,072

[45] May 4, 1982

[54] METHOD TO DRY QUENCH COKE

[75] Inventors: Erich Pries; Heinz Thubeauville, both of Bochum, Fed. Rep. of Germany

[73] Assignee: Dr. C. Otto & Comp. G.m.b.H., Bochum, Fed. Rep. of Germany

[21] Appl. No.: 99,161

[22] Filed: Nov. 30, 1979

[30] Foreign Application Priority Data

Dec. 9, 1978 [DE] Fed. Rep. of Germany ..... 2853299

[51] Int. Cl.[3] ..... C10B 39/02; C10B 45/00

[52] U.S. Cl. ..... 201/1; 201/39; 202/228

[58] Field of Search ..... 201/1, 39; 202/228

[56] References Cited

U.S. PATENT DOCUMENTS 3,774,315 11/1973 Schmalfeld et al. ..... 201/39
4,076,593 2/1978 Koizumi et al. ..... 201/39

FOREIGN PATENT DOCUMENTS 476287 2/1976 Australia ..... 201/39
2501328 7/1976 Fed. Rep. of Germany ..... 201/39

*Primary Examiner*—Bradley Garris
*Attorney, Agent, or Firm*—Thomas H. Murray; Clifford A. Poff

[57] ABSTRACT

Continuous dry quenching of coke is carried out with an inert gas circulated through hot coke in a vertical chamber and through a heat exchanger. The vertical chamber comprises a top prechamber below a charging opening and a quenching chamber which is below the prechamber. The quenching chamber has a bottom gas entry and a bottom coke discharge. A gas exit between the prechamber and the quenching chamber supplies gas to the heat exchanger. A gas entry and/or a gas exit communicating with the top of the prechamber is used to control the flow of gas so that the temperature of the gas removed from the vertical chamber remains constant during quenching operations when there is a disturbance to the flow of coke.

4 Claims, 3 Drawing Figures

METHOD TO DRY QUENCH COKE

BACKGROUND OF THE INVENTION

This invention relates to a method and apparatus to dry quench coke, and more particularly to continuously dry quenching coke in a vertical chamber with an inert gas circulated through the coke and a heat exchanger wherein the vertical chamber comprises a top prechamber below a charging opening therein and a quenching chamber below the prechamber having a bottom gas entry and a bottom coke discharge with an inert gas exit between the prechamber and the quenching chamber.

Recently, dry-quenching facilities for coke of the foregoing general type are sometimes preferred to the known forms of wet-coke quenching systems not only for economic reasons but also because dry quenching of coke causes less environmental pollution than wet quenching. The hot coke must be conveyed from the coke oven chambers in closed vessels to insure maximum suppression of dust. The coke is thereafter discharged from the closed vessels through some form of lock system into the vertical chamber where the coke is cooled with circulating inert gas.

In the event the prechamber for such a dry-coke quenching facility is large enough to contain unquenched coke from a number of coke oven chambers above the central gas exit between the prechamber and the quenching chamber, the temperature of the hot inert gas supplied to the heat exchanger remains constant during conditions of undisturbed or continuous operation. In other words, when there is a uniform coke discharge and in the absence of major disturbances to the charging of burning or hot coke to a dry-quenching facility, the inert gas can be used in a satisfactory manner to heat a steam boiler. Satisfactory operation can be maintained in the event of faults or delays occurring to the charging of hot coke into the dry cooler at least until the surface of the body of coke in the prechamber above the gas exit has descended to a point where this coke surface is close to the latter gas exit. However, in coking plants where dry cooling of this type is usually carried out, other disturbances are likely, more particularly interruptions of varying lengths to the discharge of coke from the quenching facility.

SUMMARY OF THE INVENTION

It is an object of the present invention to provide a vertical chamber for continuous dry quenching of coke such that the quenching operation and, therefore, the production of steam, if any, can continue despite relatively short interruptions and irregularities to the discharge of coke from the chamber.

According to the present invention, a conduit for the selective supply of cool inert gas or discharge of hot inert gas communicates with the upper space in a prechamber of a vertical chamber for dry quenching of coke. The features of a gas exit and a gas entry can be supplied together for the apparatus to dry quench coke.

When there is an entry for inert gas in the top of the prechamber in the event of an interruption to the coke discharge, i.e., in the event the prechamber and the cooling chamber therebelow are full of coke, only part of the cool inert gas is introduced at the bottom of the cooling chamber and another part of the cool inert gas is supplied via the entry in the top of the prechamber. The divided parts of the cool gas are in quantities such that the temperature of the inert gas discharged from the central gas exit remains equal to a steady-state value, TU, which corresponds to the hot inert gas temperature at this exit during an undisturbed operation. This form of emergency dry-quenching operation can continue until it becomes impossible to maintain a temperature TU of the gas discharged from the central gas exit.

When there is a gas exit above the coke charge in the prechamber and in the event of an interruption to the coke discharge, a portion of the inert gas entering the bottom end of the cooling chamber is removed by way of the top gas exit in a manner so that the temperature of the mixture of the two gases, that is, the gas removed from the top exit and the gas removed from the central exit, is at the normal steady-state temperature TU.

Advantageously, the height of the prechamber corresponds to from about one-half to the complete height of the quenching chamber such that a supply of hot coke is still available in the event of a disturbance, e.g., to the discharge of coke, so that operation may continue unimpaired.

These features and advantages of the present invention as well as others will be more fully understood when the following description is read in light of the accompanying drawings, in which.

Figure 2:
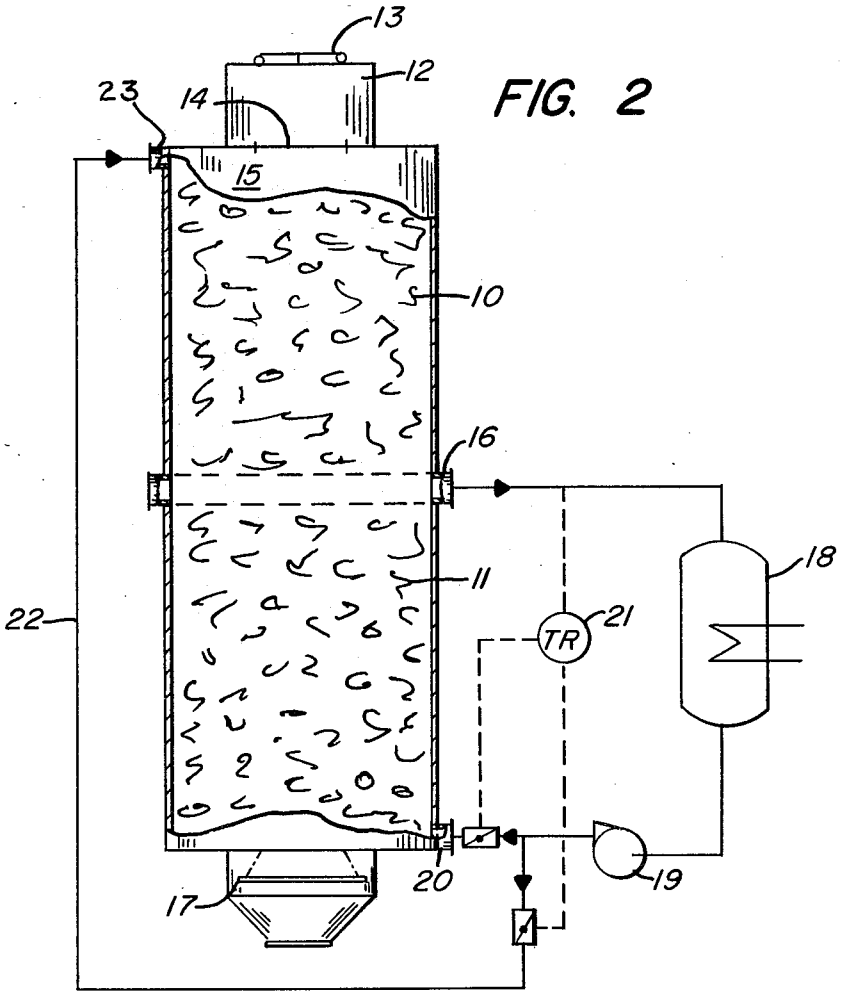
FIG. 2 is a view similar to FIG. 1 but illustrating a top entry for cool inert gas.
Figure 1:
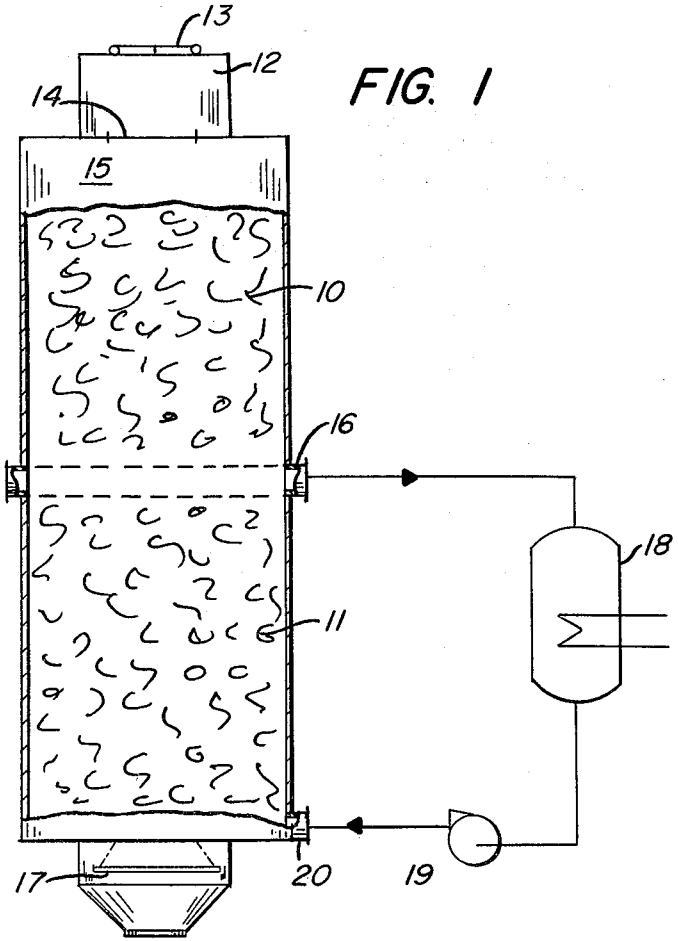
FIG. 1 illustrates a vertical chamber apparatus which is also useful for carrying out the method of the present invention to dry quench coke.
Figure 3:
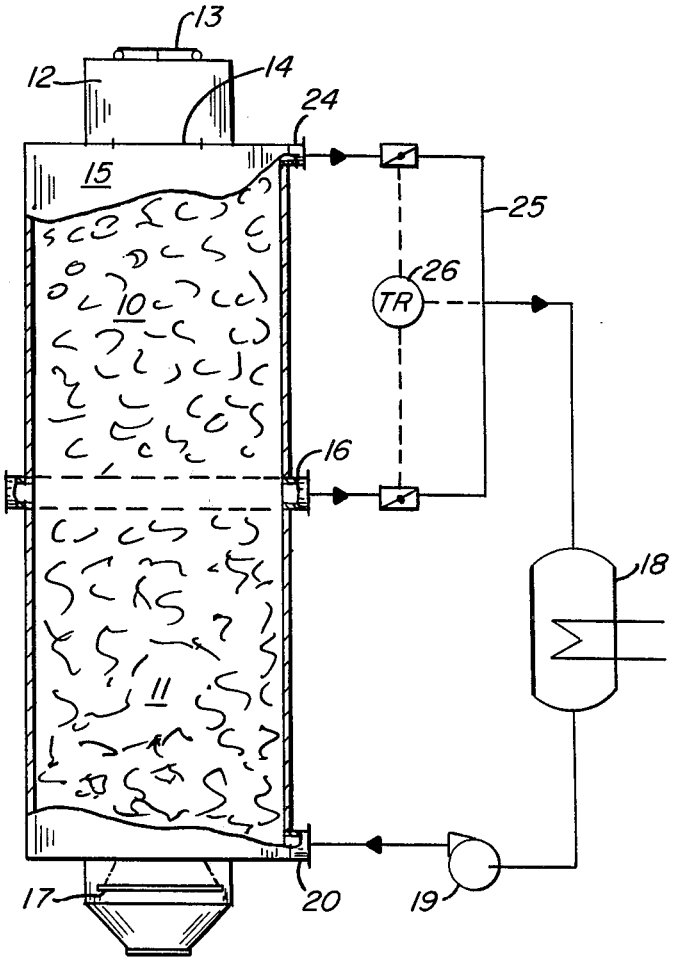
FIG. 3 is a view similar to FIG. 1 but illustrating a gas exit above a prechamber of the vertical chamber apparatus.

The vertical chamber apparatus shown in FIGS. 1–3 of the drawings includes a prechamber 10 and a quenching chamber 11. Chamber walls 12 form a charging shaft that is closed with a removable top lid or closure 13 disposed above a charging opening 14 in the top of the prechamber 10. A space 15 exists above the top of a charge of coke and the prechamber. The side wall of the vessel or vessels forming the prechamber 10 and quenching chamber 11 contains openings forming a gas exit 16 between the prechamber and the quenching chamber. Coke discharge facilitates 17 in the bottom of the quenching chamber permit the discharge of quenched coke from the chamber. Inert gas removed by the gas exit 16 is fed to a heat exchanger in the form of a steam boiler 18 and thence returned by blower 19 to the quenching chamber through a bottom gas entry 20.

In FIG. 2, a gas entry 23 communicates with the space 15 for continued operation of the coke quenching facility in the event of a disturbance affecting the discharge of coke by facility 17. A controller 21 receives signals corresponding to the temperature of the gas discharged through the gas exit 16. Through the agency of controller 21, the gas delivered by blower 19 is diverted through line 22 to gas entry 23 in a proportion sufficient to maintain the steady-state temperature, TU, of the gas issuing through the exit 16. Unless the disturbance to the coke discharge facility 17 is cleared, this emergency form of coke quenching operation continues until it is impossible to maintain the steady-state temperature of the gas leaving the prechamber and quenching chamber by exit 16.

In a further embodiment of the present invention shown in FIG. 3, there is a gas exit 24 for the flow of inert gas through quenching chamber 11 and prechamber 10 along the entire height of the two chambers.

Some of this hot inert gas is removed from space 15. The hot inert gas issuing through exit 24 passes through line 25 for admixture with the hot inert gas discharged through exit 16. The mixture of gases is then passed to steam boiler 18. A controller 26 is operatively arranged to control the quantity of gas discharged through the exit 24 so that the gas mixture supplied to boiler 18 remains at the steady-state temperature, TU, associated with a normal or undisturbed coke quenching operation. This form of emergency operation continues only for so long as it is possible to maintain the steady-state temperature, TU.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A process for the continuous dry quenching of coke in a vertical chamber by an inert gas which is fed through the coke and through a heat exchanger in a circuit, the vertical chamber defining a prechamber for hot coke located below a charging opening and a quenching chamber for quenching hot coke below the prechamber, the lower end of said vertical chamber having a gas inlet line and a coke discharger, a quenching gas discharge flue between the prechamber and the quenching chamber and a gas duct communicating with the upper part of said prechamber, said process including the steps of circulating inert gas normally only between said heat exchanger and said quenching chamber during which said inert gas in said quenching gas discharge flue defines an undisturbed quench gas steady-state temperature of operation, feeding a stream of inert gas in the event that the discharge of coke is interrupted through the coke in said prechamber for thermal exchange, varying the withdrawal of inert gas heated by the coke in the quenching chamber and the prechamber such that the temperature of a mixture of the withdrawn inert gas from the prechamber and the quenching chamber is at said undisturbed quench gas temperature, and continuing withdrawal of inert gas from said quenching chamber and prechamber as long as said temperature of a mixture is still attainable at said undisturbed quench gas temperature.

2. The process for the continuous dry quenching of coke in accordance with claim 1 wherein said step of feeding a stream of inert gas includes the further steps of feeding a partial stream of the inert gas to said quenching chamber, feeding a partial stream of inert gas to said prechamber, and wherein said step of varying the withdrawal of inert gas includes controlling the flow of inert gas of said partial streams in response to the temperature of the inert gas in said quenching gas discharge flue.

3. The process for the continuous dry quenching of coke in accordance with claim 1 wherein said step of feeding a stream of inert gas is further defined to include introducing a partial gas stream into a space in said vertical chamber above said prechamber, and wherein said step of varying the withdrawal of inert gas is further defined to include withdrawing heated inert gas essentially only through said quenching gas discharge flue.

4. The process for the continuous dry quenching of coke in accordance with claim 1 wherein said step of feeding a stream of inert gas is further defined to include introducing such gas into said vertical chamber, and wherein said step of varying the withdrawal of inert gas is further defined to include conducting heated inert gas in said quenching chamber from said quenching gas discharge flue and from said gas duct communicating with the upper part of said prechamber.

* * * * *